United States Patent [19]

Martensson

[11] 4,182,065

[45] Jan. 8, 1980

[54] FIRE-ARM

[75] Inventor: Marten Martensson, Ostersund, Sweden

[73] Assignee: A B Servator, Syltebruk, Sweden

[21] Appl. No.: 838,911

[22] Filed: Oct. 3, 1977

[51] Int. Cl.[2] ..... F41C 11/10

[52] U.S. Cl. ..... 42/12

[58] Field of Search ..... 42/12, 40, 43, 75 D, 42/1 G

[56] References Cited

U.S. PATENT DOCUMENTS

| | | | |
|---|---|---|---|
| 182,557 | 9/1876 | Castle | 42/12 |
| 477,410 | 6/1892 | Grouleff et al. | 42/12 |
| 804,349 | 11/1905 | Stendebach | 42/40 |
| 1,434,627 | 11/1922 | Petrik | 42/40 |
| 1,637,079 | 7/1927 | Karner, Jr. | 42/1 G |
| 2,259,397 | 10/1941 | Smith | 42/42 R |
| 2,376,358 | 5/1945 | Horsrud | 42/43 |
| 2,577,335 | 12/1951 | Lambert | 42/12 |
| 2,683,947 | 7/1954 | Holt | 42/75 D |
| 3,283,436 | 11/1966 | Bills et al. | 42/40 |
| 3,766,677 | 10/1973 | Waddell | 42/40 |

*Primary Examiner*—Charles T. Jordan
*Attorney, Agent, or Firm*—Stanley B. Kita

[57] ABSTRACT

An over-under firearm having at least one shot barrel and a rifle barrel superimposed relative to one another and mounted in a barrel block designed to pivot relative to a breech frame so that the rear ends of the barrels are disposed laterally for loading. The breech frame surrounds the top, bottom and one side of the barrel block, and arcuate ribs and grooves are provided between the top and bottom of the barrel block and the breech frame. A breaking mechanism is provided to displace the barrel block laterally after the barrel block has been unlocked from its operating position in the breech frame. A mechanism is provided for withdrawing the firing pin and cocking the hammers in response to further movement of the barrel block relative to the breech frame.

18 Claims, 8 Drawing Figures

1
2
3
4
5
6
7
8
9
11
12
13
14
15
16
17
18
19
20
21
22
23
24
25
59

FIRE-ARM

The present invention relates to firearms and in this connection especially to over-under sporting guns having two or more barrels.

In double-barreled firearms the barrels are usually arranged at the side of each other and in triple-barreled firearms two of the barrels are always arranged at the side of each other, whereby these firearms are opened for loading by the fact that the barrels are arranged as drop-down barrels. Known double-barreled firearms, which have the barrels arranged above each other, are also arranged as drop-down barrels when opened.

Common for such prior weapons is that they are worn out proportionately fast by the actions of the recoil, which tends to break the weapon apart. The strains on the locking device of the weapon are considerable by reason of this and the wear on the locking device is larger than that which is reasonable in consideration of its function to hold the barrels in a non-opened position. After the weapon has had only limited use, the barrels tend to separate from the breech-frame of the weapon. These are caused by a torque received with reference to the barrels and the barrels attachment in the breech-frame which is usually performed by a through-bolt. This tendency of breaking of the weapon is especially salient of weapons, which have the barrels arranged above each other. The wearing causes the barrels and the breech-frame to loosen causing the weapon after some time of use to become so deteriorated that the desired precision is lost. Besides, the resulting loosening and the recoil insure that the barrels are going to swing a little, when the weapon is fired, which swing involves an uncertain score-area.

Besides, it must be said that a perfect weapon of this type would be possible to obtain, if the barrels were arranged above each other but besides that the barrels are arranged to turn laterally, when the weapon is broken. A further demand would be that the breech block of the weapon was arranged stationary. However, it is difficult to arrange the barrels turnable laterally when breaking the weapon, when the weapon has two barrels arranged at the side of each other, in particular if the breech block is arranged stationary, as the breech-frame of the weapon will be so broad that the barrels or the barrel block when turned laterally are going to hit against the breech block. In this connection, it has been suggested to arrange the breech block turnable in an effort to arrange the barrels above each other.

However, such a perfect weapon can be effected in accordance with this invention at the same time as the weapon according to the invention will not be exposed to such a wear existing in the prior weapons. Instead the weapon according to the invention can be used all the time for which it is intended and with the same precision. Further, a weapon according to the invention can be manufactured in a considerably more rational way than corresponding prior weapons, among other things by the fact that the manufacture can be simplified and several steps of assemblage can be avoided, which last mentioned is important in view of the fact that the assembly of the weapon usually is executed by hand. One example in a simplified processing of the weapon according to the invention can be that the breech-frame can be preformed of separated pieces of metal sheet, which are joined by means of welding. Another example is that the mechanism of the weapon can be mounted as a unit within the mechanism casing of the weapon. In this case, the mechanism is arranged into the mechanism-casing from the front. Except that this involves a rational production and a simplified assembly the weapon and the mechanism of the weapon and the mechanism-casing can in a simple way be subjected to service. Further, the weapon according to the invention is going to show smooth surfaces, which makes it easier to keep up and clean the weapon at the same time as the weapon, of course, gets an aesthetic, attractive look. In a weapon according to the invention, which shows rifle barrels, it is possible to arrange the rifle barrels exchangeable and in this, it is also possible to change caliber, if it is desirable.

The weapon according to the invention is characterized in that the barrels are arranged in a barrel block, which in turn is arranged in the breech-frame of the weapon and in such a way, that said barrel block can stick out of said breech-frame, when the weapon is broken for loading, whereby said breech-frame and said barrel block are arranged in engagement with each other by means of arranged or designed protrusion portions and recesses, whereby said protrusion portions are adopted by said recesses, and which protrusion portions and recesses are located on one side or preferably on opposite sides of the barrel block respectively adjacent wall portions of the breech-frame.

By the engagement of the protrusion portions into said recesses the barrel block can attain an accurate fit into the breech-frame of the weapon, which essentially reduces the risks for unnecessary loosening between the barrel block and the breech-frame. Further, the protrusion portions and their engagement into the recesses also support to take up the actions of the recoil, when the weapon is fired and, of course, said protrusion portions also support to take up occurrent re-recoils and relieve the strains occurring at the loading, which strains act on the pivot, locking device etc. By said means can some structural details of the weapon be designed in a simplier way than in current weapons of this type.

By the fact that the barrel block is embraced and is fitted into the breech-frame one obtains an exceedingly small clearance or space between the barrel block and the breech block. Usually, the cartridge is filling out a certain portion of space between the barrel block and the breech block after a shot has been fired, whereby the barrel block cannot without special arrangements be brought to protrude from the breech-frame of the weapon. That can additionally be more difficult by the fact that the barrel block is arranged with a close fit into the breech-frame. To effect a lateral turning of the barrel block after a shot has been fired, the barrel block is shaped for cooperation with a mechanism for breaking the barrel block apart from the breech-frame. The breaking apart mechanism is arranged to displace the barrel block a small distance before the barrel block turns out laterally from the breech-frame to a tilted position, i.e. to an open position for the weapon. The barrel block also shows a removal-mechanism to facilitate the removal of the deformed cartridge from its bore.

The following is a brief description of the drawings.

Figure 1:
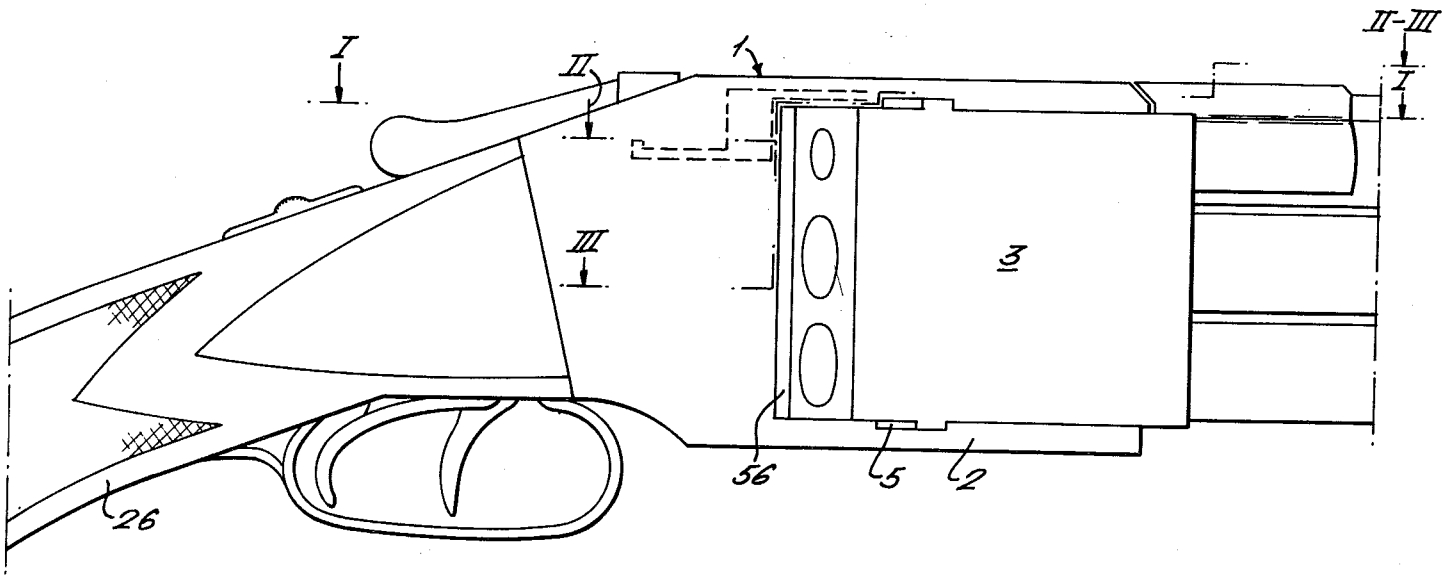
FIG. 1 is a fragmentary side elevational view of a weapon constructed according to the present invention.
Figure 3:
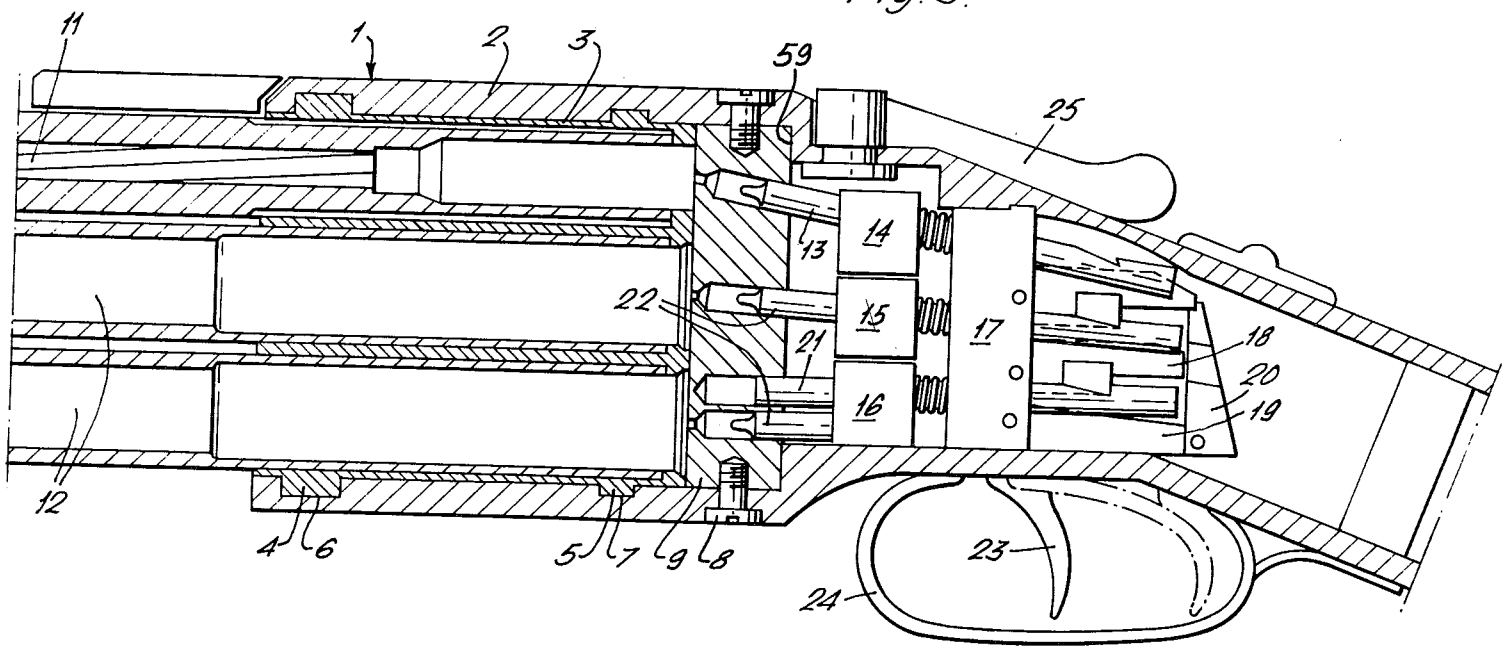
FIG. 3 is a longitudinal sectional view of the weapon.

In FIGS. 1 and 3 reference indication 1 indicates an embodiment of a weapon according to the invention, which weapon in this example consists of a drilling weapon but, of course, the weapon could instead represent a shotgun, a shotgun drilling with two rifle barrels and one shotgun barrel, a gun with one shotgun barrel and one rifle barrel, a hybrid form of a drilling having two rifle and two shotgun barrels or another weapon having two or more barrels. Thus, in the example shown in the drawing, the weapon has three barrels 11 and 12, which are arranged above each other and further arranged in a barrel block 3, whereby the upper barrel 11 consists of a rifle barrel, while the barrels 12 consist of shotgun barrels. In this connection, the rifle barrel is arranged in the barrel block by screwing and is exchangeable. The barrel block is arranged turnable in the breech-frame 2 of the weapon. For example, the breech block 9 of the weapon has screws 8 arranged in the breech-frame to fix the breech block to the breech-frame 2 and against the shoulders 59.

Further, the weapon has an upper firing pin 13, an upper hammer 14, a center hammer 15, a lower hammer 16, a trigger stud 17, a sear or a trigger rod 18 for the upper shotgun barrel, a sear or a trigger rod 19 for the lower shotgun barrel, a trigger guide 20, a bar for the firing pin spring 21, firing pins 22, a trigger 23, a trigger guard 24, a top-lever 25 and a butt end with a small of the butt 26.

Figure 2:
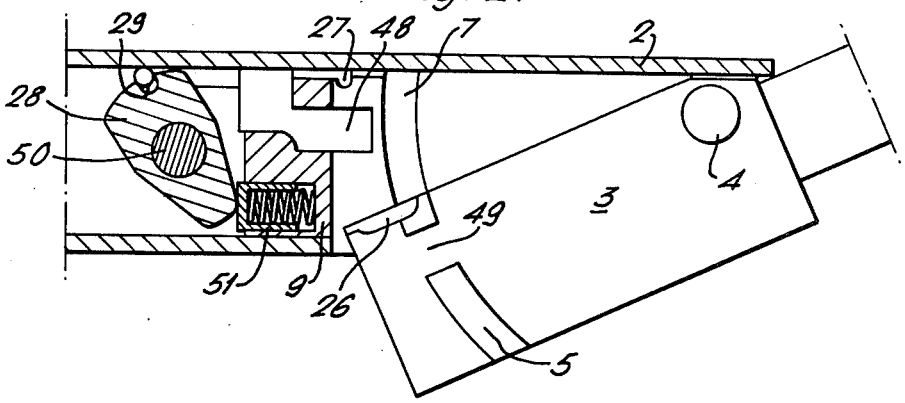
FIG. 2 is a sectional view taken on line I—I of FIG. 1.

Now a further reference to also FIG. 2, in which figure the turned out position of the barrel block 3 from the breech-frame 2 is evident and in which position the weapon is broken for loading. In this case, the barrel block is pivoted in the breech-frame by means of hinge devices 4, for example consisting of arranged or designed pivot pins, which reach into recesses 6 of the breech-frame and form a fixed pivot for the barrel block. Further, it is evident from said figures that the barrel block 3 shows arranged or designed protrusion portions 5, which are intended to be located into grooves 7 in the breech-frame 2.

Figure 4:
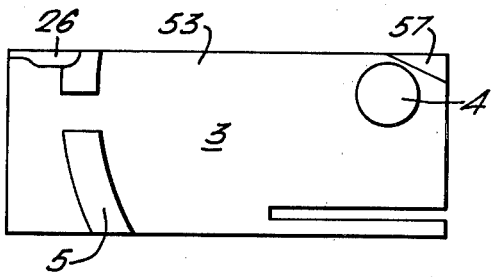
FIG. 4 is a plan view of a barrel block used in the weapon.
Figure 5:
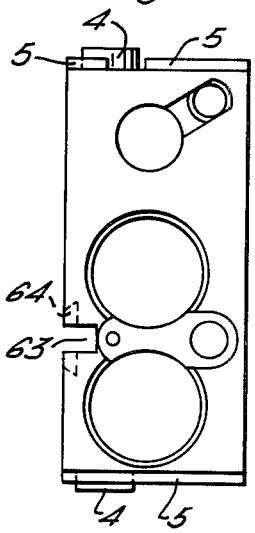
FIG. 5 is an end view of the barrel block illustrated in FIG. 4.

The barrel block 3 of the weapon is shown in FIGS. 4 and 5, whereby the barrel block consists in the main of an rectangular-shaped body, whereby one of the barrel block edges is designed with a chamfering portion 56 along the total height of the barrel block, see FIG. 1, whereby the chamfering portion has a connection with the breech block. Further, the breech block has grooves 57, which are located adjacent to an edge of the barrel block and designed adjacent to the upper side and the lower side of the barrel block, and a groove 26, which functions has connection with the break device of the weapon. The upper surface 53 of the barrel block and the opposite lower surface have the pivot pin 4, by which the barrel block is arranged for turning or pivoting in the breech-frame 2. The surfaces of the barrel block also have the protrusion portions 5, which consist of ridge shaped projections, preferably in the shape of ribs.

The position of the fixed pivot of the barrel block can be moved and be located by the side of the common symmetry plane of the barrels, as it has been evident from the figures. The fixed pivot of the barrel block is located at a distance of and parallel to a symmetry plane through the barrel block or through a common symmetry plane through the barrels 11 and 12. By this, it is possible to arrange the breech block 9 stationary. In addition, the barrel block has a chamfered portion 56 to make it easier to turn the barrel block. The weapon will not when firing have a tendency to be broken because of the actions of the recoil, if said fixed pivot is arranged so near as possible to the symmetry plane of the barrels. A tendency to become broken arises to a certain degree because the centrum of the barrels and the fixed pivot are not in accordance with each other; however, as it appears in FIG. 5, the fixed pivot is located in a plane through the barrel block which touches the bore of the riffle barrel.

Figure 6:
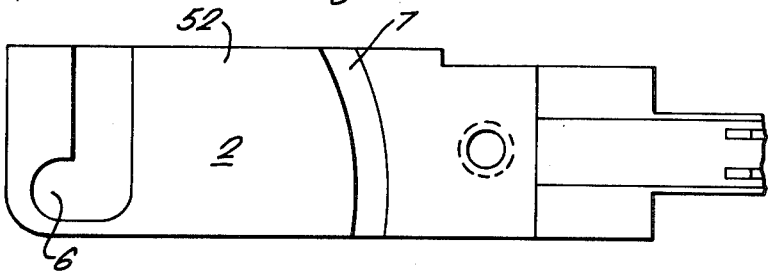
FIG. 6 is a fragmentary view of the breech frame of the weapon.

The breech-frame 2 has two spaced apart opposite walls and a panel between the opposite walls extended side-wall, which different walls can consist of separated shapes of sheet metal sheet billets, which are joined by means of welding to form the breech-frame intended. Thus in FIG. 6 is shown a portion of the lower breech-frame wall 52. Grooves 6 and 7 are shaped in this breech-frame wall and in the opposite breech-frame wall, whereby said grooves extend in one direction from a free edge of the breech-frame and further extends in a prolongation perpendicular to said first mentioned direction of the groove. The grooves 7 extend in the main across the walls of the breech-frame and the grooves are shaped for adopting the ribs 5, which protrude from the barrel block, whereby the grooves preferably adopt the ribs in a close fit. The protruded portions or ribs 5 and the corresponding recesses or grooves 7 have surface portions which are meant to lie close to each other and which extend in the main crosswise (perpendicular to) the direction of the weapon. The ribs and also the grooves are shaped bent or along a curved line to make it possible to turn the barrel block 3 in the breech-frame and for the reason to make the ribs engageable with the grooves with a close fit.

Figure 7:
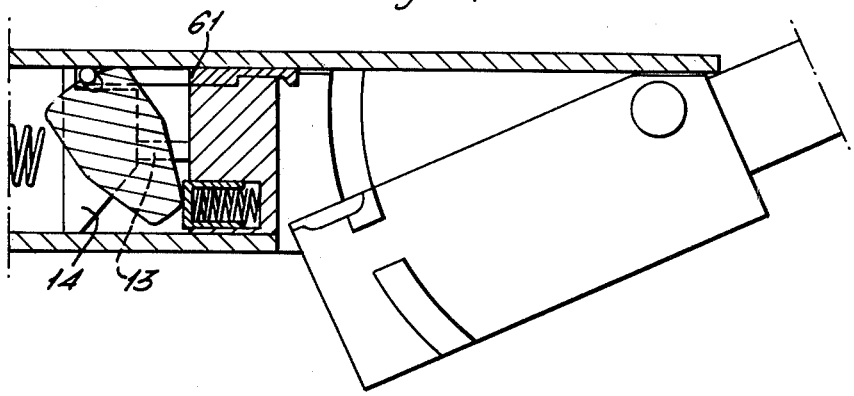
FIG. 7 is a sectional view taken on line II—II of FIG. 1.

In FIG. 2 is shown the lock of the weapon, which includes a lock arm with a lock bolt 48 and which is intended to be pushed into a notch 49 or a break in the protruding rib 5 of the barrel block. In this case, the lock bolt is designed to be integral with a portion of the breaking device which has a pin with a cam 27 included in the break-apart mechanism. The locking device and the break device are controlled by turning of the top-lever 25 of the weapon top-lever, which is joined with a turnable plate 28 having a hack 29 in engagement with one from or to the lock bolt and the break pin projecting arm 61, see FIG. 7. The turning plate 28 is arranged for turning against the action of a spring-loaded sliding sleeve 51, to hold the lock bolt 48 in a locked position in the barrel block and also the break pin 27 in a neutral position. The locking device can be shaped in a simple way and there is no need for a double or triple interlocking device as the known weapons show as there exists potent torques, as the result of the torque of the barrel block according to the invention is small as regards the action of the recoil.

The break mechanism is arranged in the breech-frame 2 and is designed to extend into the recess 26 of the barrel block 3 by the break pin 27. The break pin is equipped with a cam or the like and when the brake pin is moved in the direction from the barrel block, the cam of the break pin is arranged to engage with the cam surface, which is arranged in the cavity of the barrel block, whereby the barrel block is displaced in the turning-direction of the barrel block. This displacement is only a short displacement in consideration of that displacement of the barrel block which the barrel block is arranged to perform when the weapon is fully broken for loading. The displacement when broken the weapon with the break mechanism is only up to about 1 mm.

The projecting arm 61, which projects from the lock bolt and the break pin, is arranged also to push or move the upper hammer 14 in a direction from the breech-block 9 and in that case bring the end portion of the firing pin 13 into the breech-block, whereby the firing pin is protected against damaging or breaking off when opening the weapon. By means of the top-lever 25, the weapon is according to the above several functions controlled, and besides the weapon is cocked by the fact that an arm is arranged to move the safety-catch to a cocked position of the weapon.

Figure 8:
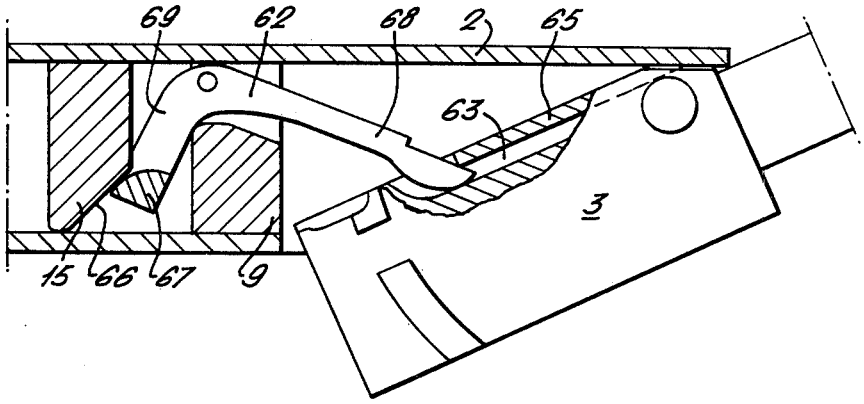
FIG. 8 is a sectional view taken on line III—III of FIG. 1.

In FIG. 8 reference indication 62 indicates a cocking lever in the cocking-mechanism of the weapon. The cocking lever shows in the main a L-form and is pivoted in its knee-portion. One of the legs 68 of the lever is arranged to be in engagement with the barrel block 3, while the other leg 69 of the lever is arranged to lie close to at least one hammer or to the hammer 15 shown in the figure. Hence, the barrel block shows a recess or groove 63 for adopting the end portion of the lever 68 of the cocking lever. Further, a dovetailed groove 64 is arrangeed in the barrel block and adjacent to said former groove and which dovetailed groove adopts a slide 65 consisting of a thin metal sheet. The slide is arranged to leave an opening to the first mentioned groove for the end portion of the leg of the cocking lever. The hammer 15, which is shown in the FIG. 8 is designed with an oblique plane 66 and the adjacent leg 69 of the cocking lever has a shoulder 67 with a bent surface portion, which is intended to lie close against said oblique plane and arranged to slide against the hammer in order to move the hammer to cock the mechanism.

When the barrel block is turned out from the breech-frame 2, the cocking lever 62 is turned by the fact that the cocking lever is in engagement with the barrel block, whereby the first mentioned leg 68 of the cocking lever is removed from the position adjacent to the wall of the breech-frame at the same time as the end portion of the other leg 69 is pushing the hammer 15 or the hammers in a direction from mounting point of the cocking lever. Except when the cocking lever is arranged so as to cock the mechanism, the turning potential of the barrel block in the breech-frame is limited because the end portion of the first mentioned leg 68 of the cocking lever cannot pass the adjacent end portion of the slide 65. Thus, since the end of the leg 68 remains between the slide and the bottom of the groove 63, the cocking lever maintains its engagement with the barrel block. The cocking lever has been designed with said L-form and the cooperating portions between the cocking lever and the hammer or hammers have also been designed in this way owing to the fact that the mechanism will be cocked notwithstanding the fact that the opening-angle of the weapon is proportionally small. Thus, the cocking lever 62 pushes with its bent surface portion of the shoulder 67 against the oblique plane 66 of the hammer or hammers 14, 15 and 16 whereby only a small move is required to obtain a great relative movement between the cocking lever and the hammer or hammers.

The forestock of the weapon according to the invention is arranged to the barrel block 3 and joined with the slide 65, whereby the weapon is kept together when it is opened. When dismantling the weapon into pieces a spring-loaded locking-lever is released, whereby the forestock can be moved forward. In this, the slide is brought with the forestock and the barrel block can then be turned out further and be removed from its fixed pivot with the breech-frame. However, in the shooting position the slide and the forestock are locked.

The weapon according to the invention fullfils the demands from, for example, huntsmen in that a correct score-area can be obtained, which depends on the fact that the barrels are arranged above each other and the fact that the barrels are arranged for tilting sideways, for example when loading the weapon. According to the invention the barrels 11 and 12 are further arranged stationary between themselves by the fact that they are arranged in the barrel block and further, the barrels are along the barrels direction or preferably at the free end of the barrels unit of a holder. According to another embodiment the rifle barrel 11 is arranged in one direction, while the shotgun barrels 12 are arranged in a small angle to the rifle barrel. The angle between the directions of the shotgun barrels and the rifle barrel is about 0.5° or at most 2° but preferably between 0.3° and 0.7°. Several advantages are obtained by the stationary arrangement of the barrels and further that they are arranged inclined to each other. Among other things one obtains a more correct score-area and from the viewpoint of accuracy in firing the weapon has been considerably improved compared with prior weapons of this type. Besides, one obtains a considerably easier weapon to handle when using the weapon according to the invention, which depends on the fact that one can make use of stationary sights, i.e. bead and sight are arranged stationary, whereby there is no need to adjust the sights after using the rifle barrel to a use of a shotgun barrel. Thus, prior weapons of this type have an especial "switch over" device, by which a specific rifle sight is lowered before a bullet is to be fired. A "switch over" handle of the sight is troublesome, particularly when a huntsman is in the position of firing a shot. When using the weapon according to the invention obe obtains instead a perfect bullet and shot dispersion by using the arranged stationary sights.

Without exceeding the scope of the concept of the invention, modifications may be made to the weapon shown and described. Thus, the protruded rib portions of the barrel block can have an another shaping but the protrusion portions must be located along a bent or curved line in that case the barrel block is arranged turnable in the breech-frame. Further, said protrusion portions concerning guiding lists and fixed pivot can be instead be shaped in the breech-frame, whereby the barrel block has the corresponding recesses or grooves. It is also conceivable that said protrusion portions constitutes the hinge or the fixed pivot. It is essential that the barrel block is in engagement with the breech-frame with the opposite side surfaces of the barrel block, which are furthest from each other, whereby the barrels, which are arranged in the barrel block, are located in a plane between said surfaces. Therefore, the invention is not limited to the embodiment shown and described, but only by the following patent claims.

I claim:

1. An over-under firearm comprising: a breech frame, a barrel block, at least two barrels mounted in said barrel block and superimposed relative to one another, and means mounting said barrel block to pivot about a vertical axis relative to said breech frame so that the rear ends of said barrels are offset laterally with respect to said breech frame for loading and unloading, said barrel block mounting means including upper and lower extensions on said breech frame overlying and underlying respectively said barrel block to sandwich said barrel block therebetween, means providing hinge pins between said barrel block and said extensions, and means providing curved mating rib and groove connections disposed between said upper and lower extensions and said barrel block and curved transversely in a horizontal plane to afford said pivotal motion.

2. An over-under firearm according to claim 1 wherein said breech frame has a vertically-disposed panel connecting said extensions, said hinge pins are offset from the plane of the barrels toward said panel.

3. An over-under firearm according to claim 2 wherein the magnitude of the offset corresponds substantially to the radius of the bore of one of the barrels.

4. An over-under firearm according to claim 1 including means for breaking open the barrel block from the breech frame, said breaking means including a cam surface on said barrel block, a cam engageable with said cam surface, and means for urging said cam against said cam surface to cause said barrel block to pivot away from said breech frame.

5. An over-under firearm according to claim 4 including a recess in said barrel block providing said cam surface, and means mounting said cam for movement rearwardly against said cam surface to break said barrel block away from said breech frame.

6. An over-under firearm according to claim 1 including means for locking the barrel block in operating relation in said breech frame, means for breaking said barrel block away from the breech frame, and means coupling said locking means and said breaking means together so that said breaking means operates to displace the barrel block away from the breech frame upon disengagement of the locking means.

7. An over-under firearm according to claim 6 including firing pin means mounted for axial movement in said breech frame, and means moveable with said breaking means to withdraw said firing pin means into said breech frame upon actuation of said breaking means to break said barrel block away from said breech frame.

8. An over-under firearm according to claim 1 including firing pin means mounted in said breech frame, hammer means carried in said breech frame for operatively engaging said firing pin means, and cocking means cooperating with said barrel block upon breaking thereof away from said breech frame to displace said hammer means into a cocked position for subsequently engaging said firing pin means.

9. An over-under firearm according to claim 8 wherein said cocking means includes a cocking lever mounted in said breech frame, one end of said cocking lever engaging said barrel block and the other end of said cocking lever adapted to engage said hammer means so that outward pivotal movement of the barrel block causes the cocking lever to engage the hammer means and displace it rearwardly into said cocked position.

10. An over-under firearm according to claim 9 wherein said one end of said clocking lever slides in a groove in said barrel block, and including cooperating stop means on said one end and on said barrel block to limit outward pivotal movement of said barrel block relative to said breech frame.

11. An over-under firearm according to claim 9 wherein said other end of said cocking lever has a curved surface and said hammer means has an inclined surface adjacent thereto so that pivotal movement of the cocking lever cams the hammer means rearwardly in the breech block.

12. An over-under firearm according to claim 1 wherein said breech frame extensions have hinge pin grooves extending laterally for receiving said hinge pins to afford lateral disengagement of the barrel block from the breech frame.

13. An over-under firearm according to claim 1 including a breech block, and means mounting said breech block in said breech frame, including shoulders disposed against said breech block and means releasably fastening said breech block in said frame against said shoulders.

14. An over-under firearm according to claim 13 wherein said shoulders are located behind said breech block adjacent its top and bottom and said fastening means includes screws threaded into said breech block through said breech frame.

15. An over-under firearm according to claim 1 wherein one of said barrels includes a rifle barrel and the other of said barrels includes a shot barrel, the rifle barrel being disposed at a small angle along said shot barrel.

16. An over-under firearm according to claim 15 wherein said angle is less than 2°.

17. An over-under firearm according to claim 16 wherein said angle is in a range of 0.3° to 0.7°.

18. An over-under firearm according to claim 15 wherein said rifle barrel overlies the shot barrel and including another shot barrel disposed below said one shot barrel in parallel relation therewith.

* * * * *